US005760760A

United States Patent [19]

Helms

[11] Patent Number: 5,760,760

[45] Date of Patent: Jun. 2, 1998

[54] INTELLIGENT LCD BRIGHTNESS CONTROL SYSTEM

[75] Inventor: Frank P. Helms, Round Rock, Tex.

[73] Assignee: Dell USA, L.P., Austin, Tex.

[21] Appl. No.: 503,346

[22] Filed: Jul. 17, 1995

[51] Int. Cl.[6] ..... G09G 3/36

[52] U.S. Cl. ..... 345/102; 345/63; 345/207

[58] Field of Search ..... 345/63, 102, 101, 345/211, 207, 199; 348/602

[56] References Cited

U.S. PATENT DOCUMENTS

| | | | |
|---|---|---|---|
| 5,029,982 | 7/1991 | Nash | 345/101 |
| 5,270,818 | 12/1993 | Ottenstein | 348/602 |
| 5,315,695 | 5/1994 | Saito et al. | 345/63 |
| 5,406,305 | 4/1995 | Shimomura et al. | 345/102 |

FOREIGN PATENT DOCUMENTS

| | | |
|---|---|---|
| 3-94220A | 4/1991 | Japan . |
| 5-19234A | 1/1993 | Japan . |

*Primary Examiner*—Xiao Wu
*Assistant Examiner*—Xu-Ming Wu
*Attorney, Agent, or Firm*—Haynes and Boone L.L.P.

[57] ABSTRACT

Method and apparatus for automatically adjusting the brightness level of an LCD based on the ambient lighting conditions of the environment in which the LCD is being operated are disclosed. In a preferred embodiment, a photodetector located proximate the front of the LCD generates to brightness control circuitry signals indicative of ambient lighting conditions. These signals are correlated to predetermined automatic brightness control values for use in controlling the brightness level of the LCD. Once the ambient light signals have been used automatically to set the brightness level of the LCD, user-selection of a different brightness level, either higher or lower, will override the automatic brightness control setting. In an alternative embodiment, a first photodetector is located proximate the front of the LCD and a second photodetector is located proximate the back of the LCD. In this embodiment, the brighter ambient condition is used to control the brightness level of the LCD. In another alternative embodiment, the brightness control circuitry comprises some form of artificial intelligence for "learning" a user's preferred brightness level, or range of brightness levels, in various ambient lighting conditions.

8 Claims, 2 Drawing Sheets

INTELLIGENT LCD BRIGHTNESS CONTROL SYSTEM

TECHNICAL FIELD

The invention relates generally to liquid crystal displays (LCDs) and, more particularly, to a system for automatically adjusting the brightness of an LCD responsive to the amount of ambient light available during operation thereof.

BACKGROUND OF THE INVENTION

Liquid crystal displays (LCDs) are used in portable personal computers (PCs) and other electronic devices to display information. LCDs modulate light to create images using selectively transmissive and opaque portions of the display, the selection being controlled by passing electrical current through the liquid crystal material Transmissive-type LCDs are illuminated by an artificial backlight positioned behind the LCD glass to provide the contrast between the light transmissive and opaque portions of the display.

The LCD backlight is one of the primary sources of power consumption in a portable PC and the power consumed by the backlight is directly related to the brightness level selected. Therefore, it would be advantageous, from a power consumption standpoint, to operate the PC with the LCD at the lowest possible brightness level at which the contents of the display can still be seen by the user. For example, in a particular portable PC model available from Dell Computer Corporation of Austin, Tex., operating the PC with the LCD set to the minimum brightness level as compared to the maximum brightness level, can reduce overall power consumption of the PC by approximately twenty percent (20%), which in turn increases the runtime of the PC between battery charges by the same percentage. Specifically, assuming that in the example just described the PC has a typical runtime between battery charges of 8 hours with the LCD set to the maximum brightness level, decreasing the brightness level to the minimum level will increase the runtime of the PC to 9.6 hours.

In view of the foregoing, it is apparent that a user could significantly increase the runtime between battery charges of his or her portable PC by taking advantage of ambient lighting conditions that increase the visibility of the LCD, that is, low ambient light, and decreasing the brightness level of the LCD whenever the PC is being operated in such lighting conditions. Specifically, it is obvious that the contents of an LCD can be much more easily viewed in a dark room than a bright one. Hence, a user could take advantage of that fact by decreasing the brightness level of the LCD whenever ambient lighting conditions permit and then subsequently increasing the brightness level only when necessitated by bright ambient lighting conditions.

While foregoing manual brightness adjustment presents a viable option for increasing the runtime of a PC between charges, it is deficient in certain respects. In particular, while a user may begin by operating the PC with the LCD brightness set to the minimum level necessary to enable the contents of the display to be perceived, after a user has moved with the PC to an environment in which the ambient lighting conditions require that the LCD be set to the maximum brightness level, the user will typically forget to decrease the brightness level upon returning to an environment in which the ambient lighting conditions would be conducive to such a decrease. As a result, the power savings are not as substantial as might be the case were the brightness adjustment to occur automatically.

Accordingly, what is needed is an intelligent LCD brightness control system which automatically adjusts to the ambient lighting conditions of the environment in which the PC is being used.

SUMMARY OF THE INVENTION

The foregoing problems are solved and a technical advance is achieved by method and apparatus for automatically adjusting the brightness level of an LCD based on the ambient lighting conditions of the environment in which the LCD is being operated. In a departure from the art, a photodetector located proximate the front of the LCD generates to brightness control circuitry signals indicative of ambient lighting conditions. These signals are correlated to automatic brightness control values for use in controlling the output of the backlight driver circuit which determines the brightness level of the LCD.

In one embodiment of the present invention, signals indicative of a user-selected brightness level are also input to the brightness control circuitry and taken into account in to the adjustment of the brightness level of the LCD. In one aspect of the invention, once the ambient signals have been used automatically to set the brightness level of the LCD, subsequent user-selection of a different brightness level, either higher or lower, will override the automatic brightness control setting.

In an alternative embodiment, a first photodetector is located proximate the front of the LCD and a second photodetector is located proximate the back of the LCD. In this embodiment, the brighter ambient condition is used to control the brightness level of the LCD. This embodiment is especially usefull in situations in which light is directed toward the back of the LCD, and hence toward the user's eyes, which light, while affecting the visibility of the LCD, might not be detected by the first photodetector.

In another alternative embodiment, the brightness control circuitry comprises some form of artificial intelligence for "learning" a user's preferred brightness level, or range of brightness levels, in various ambient lighting conditions.

A technical advantage achieved with the invention is that it provides increased run-time between battery charges by lowering the brightness level of an LCD during use in low ambient lighting conditions.

Another technical advantage achieved with the invention is that the adjustment of the brightness level occurs automatically without user intervention, thereby reducing the possibility that a user may set the brightness level at a maxium level during use in high ambient lighting conditions and subsequently neglect to lower the level upon returning to a low ambient lighting condition.

Another technical advantage achieved with the invention is that, in at least one embodiment, the user may override the automatic brightness control setting using a conventional LCD brightness control means.

Yet another technical advantage achieved with the invention is that the brightness control circuitry can be configured to "learn" a user's preferred brightness settings in various ambient lighting conditions, thereby obviating the need for the user to readjust the brightness level and override the automatic brightness control setting each time such ambient lighting conditions are entered.

DETAILED DESCRIPTION OF THE PREFERRED EMBODIMENT

Figure 1:
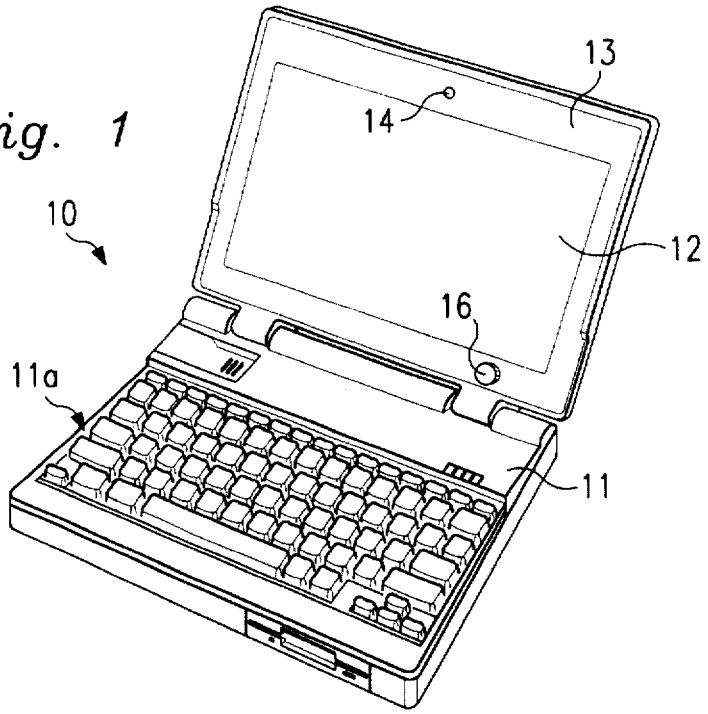
FIG. 1 is a front perspective view of a portable personal computer (PC) embodying features of the present invention.

FIG. 1 illustrates a portable personal computer (PC) 10 embodying features of the present invention and comprising a base 11 including a keyboard 11*a*, a liquid crystal display panel (LCD) 12 disposed in a lid portion 13 of the PC 10, and at least one photodetector or light sensor 14 disposed on the same side of the lid portion 13 proximate the LCD 12, for detecting a level of ambient light directed toward the front of the LCD 12 and for generating signals indicative of same. A user-selected brightness control level may be input via conventional methods and stored in a nonvolatile memory device, as shown in FIG. 2, for enabling the user manually to adjust the brightness level of the LCD 12.

Figure 2:
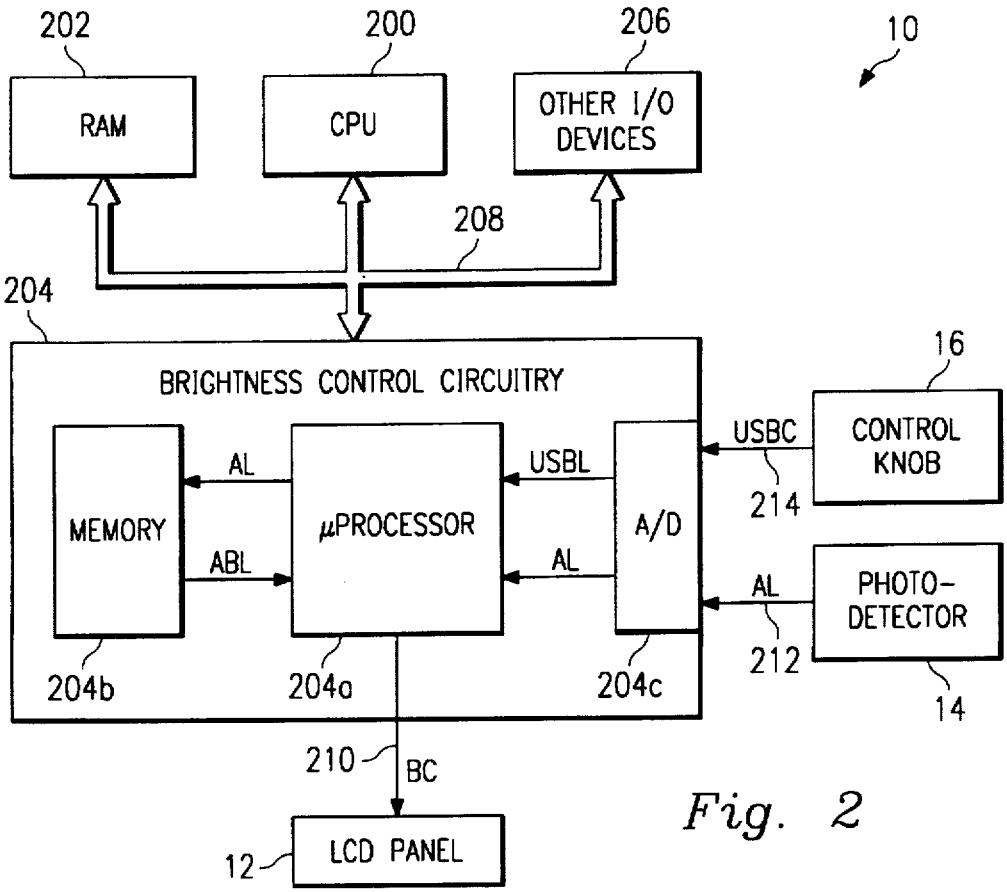
FIG. 2 is a system block diagram of the portable PC of FIG. 2.

FIG. 2 is a system block diagram of the PC 10 of FIG. 1. As shown in FIG. 2, the PC 10 comprises a CPU 200, system RAM 202, brightness control circuitry 204, and other I/O devices 206, including the keyboard 11*a* (FIG. 1), electrically interconnected via a bus 208. In the preferred embodiment, the brightness control circuitry comprises a microprocessor 204*a*, memory 204*b*, and an analog-to-digital ("A/D") converter 204*c* for purposes that will subsequently be described in detail.

An output of the microprocessor 204*a* is electrically connected to the Backlight driver circuitry 213 in a conventional manner for generating brightness control or "BC," signals thereto via a line 210 for controlling the brightness level of the LCD 12 at any given time. In addition, analog signals generated by the photodetector 14 indicative of the level of ambient light striking the front of the LCD 12 (hereinafter "ambient light" or "AL" signals), as well as a digital signal indicative of the brightness level selected by the user (hereinafter "user-selected brightness level" or "USBL" signal) and stored in a nonvolatile memory device, such as NVRAM 211, are input to the brightness control circuitry 204 on lines 212, 214, respectively. The analog AL signals are converted to digital signals by the analog-to-digital converter 204*c* and then input to the microprocessor 204*a*.

A plurality of automatic brightness level ("ABL") signal values, each of which corresponds to a particular one of a plurality of various possible AL signal values, are stored in the memory 204*b*. It will be understood that the ABL signal value associated with each of the AL signal values will be determined empirically and will depend, at least partially, on the relevant parameters of the particular LCD 12, as well as a subjective determination of the optimum LCD brightness level for operation in the given ambient lighting condition. In one embodiment, the ABL signal values are stored in the memory 204*b* as a lookup table indexed by the input AL signal value, such that input of an AL signal thereto via the microprocessor 204*a* results in the output therefrom of the corresponding ABL signal, although various other manners of implementation are anticipated. In any event, once the microprocessor 204*a* accesses from the memory 204*b* the ABL signal value corresponding to the AL signal input thereto, it outputs to the Backlight driver circuitry 213 an appropriate BC signal for adjusting the brightness level of the LCD 12 in accordance with the levels indicated by the USBL and AL signals, as will be described in detail with reference to FIG. 3.

Figure 3:
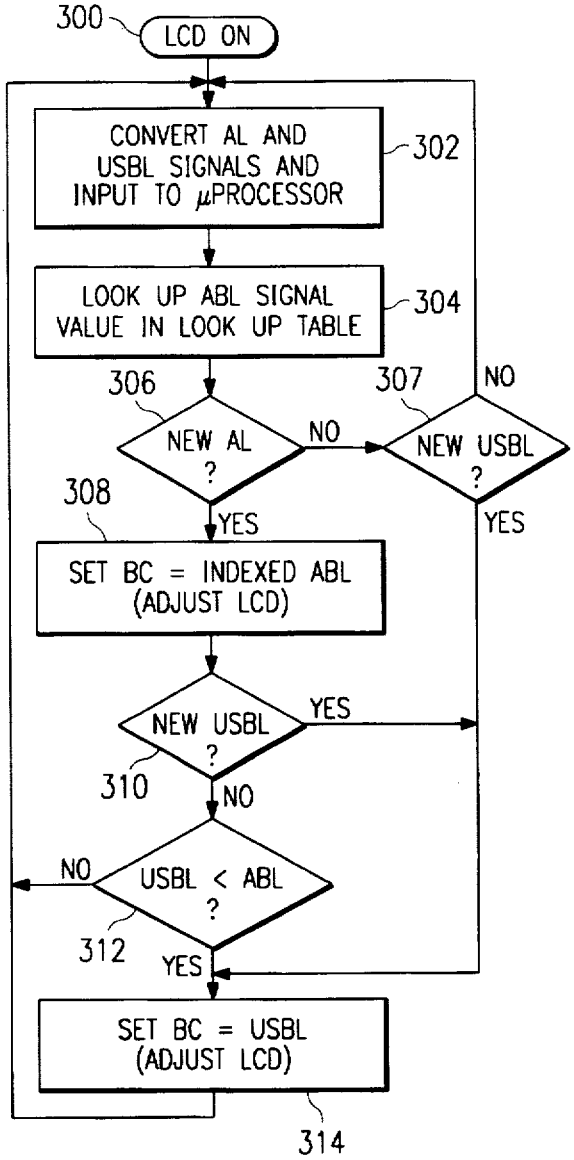
FIG. 3 is a flowchart of the operation of brightness control circuitry for implementing the method of the present invention.

FIG. 3 is a flowchart of the operation of the brightness control circuitry 204 for inplementing the preferred embodiment of the present invention. It should be understood that instructions for execution by the microprocessor 204*a* for inplemnenting the invention are preferably stored in memory 204*b*. Execution begins in step 300 when the LCD 12 is turned on. In step 302, after the analog AL signal generated by the photodetector 14 has been converted to a digital signal by the A/D converter 204*c* and input to the microprocessor 204*a*, it is used to index the ABL signal lookup table (not shown) stored in the memory 204*b*. Also in step 302, the BC signals output to the backlight driver circuitry 213 for controlling the brightness level of the LCD 12 is set to correspond to the ABL signal indexed by the AL signal In this manner, the brightness level of the LCD 12 is adjusted according to the current ambient lighting conditions in which the PC 10 is being operated. It should be understood that, alternatively, upon power up of the LCD 12, the BC signal may initially be set to equal the value of USBL as stored in the NVRAM 211, such that the brightness level of the LCD 12 is set to correspond to the previous user-selected level, rather than the ambient lighting conditions.

In step 304, a determination is made whether the AL signal has changed, indicating that the ambient lighting conditions have changed. If so, execution proceeds to step 306. In step 306, the new AL signal is again used to index the ABL signal lookup table (not shown) stored in the memory 204*b*. Also in step 306, the BC signals output to the backlight driver circuitry 213 for controlling the brightness level of the LCD 12 is set to correspond to the ABL signal indexed by the AL signal thereby adjusting the brightness level of the LCD 12 according to the new ambient lighting conditions. Execution then proceeds to step 308. Similarly, if in step 304, it is determined that the AL signal has not changed, indicating that no adjustment for ambient lighting conditions is necessary, execution proceeds directly to step 308.

In step 308, a determination is made whether the USBL signal has changed. If the USBL signal has not changed, execution returns to step 304. In contrast, if the USBL signal has changed, indicating that the user has attempted to manually change the brightness level of the LCD 12, execution proceeds to step 310. In step 310, the BC signal output to the backlight driver circuitry 213 is set to correspond to the USBL signal. Once the brightness of the LCD 12 has been set to the level indicated by the USBL signal in step 310, execution returns to step 304.

In this manner, the brightness control circuitry 204 ensures that the brightness level of the LCD 12 is always automatically set to the level dictated by the current ambient lighting conditions, unless the user selects a different brightness level subsequent to a change in the ambient lighting conditions, in which case the level selected by the user is used to control the brightness level of the LCD 12. As a power saving measure, an additional step could be added in which a comparison is made between the level of the AL and USBL signals and, responsive to the comparison, the brightness level of the LCD 12 is dictated by the lower (ie., dimmer) of the two signals. It should be noted, however, that this may result in a situation in which the LCD 12 cannot be read, for example, where a user moves from low to high ambient lighting conditions without manually readjusting the brightness setting.

Figure 4:
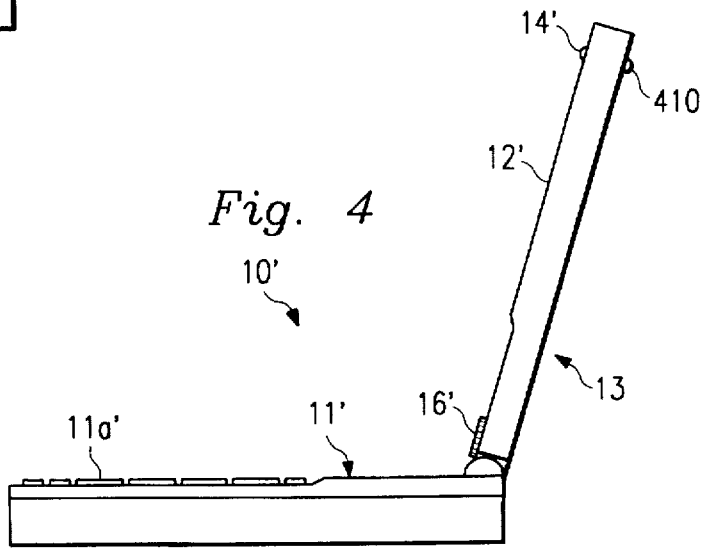
FIG. 4 is a rear perspective view of a portable PC embodying features of an alternative embodiment of the present invention.

FIG. 4 is a rear perspective view of a portable PC 10' embodying features of an alternative embodiment of the present invention. In particular, in addition to comprising all of the same features of the PC 10 shown in FIG. 1, including a base 11', a keyboard 11*a'*, an LCD 12' disposed in a lid 13', a first photodetector 14' and a user-actuatable brightness control means (not shown), the PC 10' further comprises a second photodetector 410 disposed on the opposite side of the lid 13' as the LCD 12' and first photodetector 14', for detecting ambient light directed toward the back side of the LCD 12' and toward a user's eyes.

In the alternative embodiment, the greater of an AL signal generated by the photodetector 14' and an AL signal generated by the photodetector 410 is used to index the lookup table comprising ABL signal values, as described with reference to FIGS. 2 and 3. In this manner, the brighter ambient lighting condition is used to determine the ABL signal value for use in adjusting the brightness level of the LCD 12'. It will be apparent that, with this alternative embodiment, the user is insured that the contents of the LCD 12' will be visible where, for example, the area behind the LCD 12' is highly illuminated, but the area in front of the LCD 12' is not. This might not be the case absent the second photodetector 410 as shown in FIG. 4, the brightness level of the LCD 12' would most likely be set too low for the user comfortably to view the contents thereof. Alternatively, a weighted average of the AL signals generated by the photodetectors 14' and 410, as computed by the microprocessor 402*a*, could be used to index the lookup table.

In another alternative embodiment of the invention, as described with reference to FIGS. 2 and 5, the brightness control circuitry 204 comprises some form of artificial intelligence designed to adjust the lookup table ABL entries stored in the memory 204*b* according to current and previous USBL signals generated in response to a particular detected ambient lighting conditions. In this manner, the brightness control circuitry 204 "learns" the users preferred settings for particular lighting conditions, thereby minimizing the number of times the user must manually adjust the brightness level to override the automatic settings.

Figure 5:
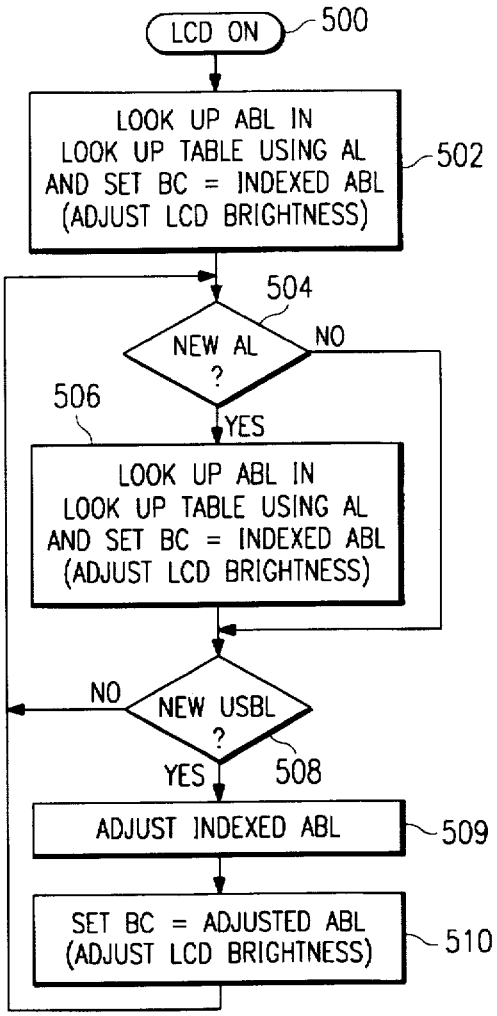
FIG. 5 is a flowchart of the operation of brightness control circuitry for implementing an alternative embodiment of the method of the present invention.

Referring to FIG. 5, execution begins in step 500 when the LCD 12 is turned on. In step 502, once the analog AL signal generated by the photodetector 14 is converted to a digital signal by the A/D converter 204*c* and input to the microprocessor 204*a*, it is used to index the ABL signal lookup table (not shown) stored in the memory 204*b*. Also in step 502, the BC signal output to the backlight driver circuitry 213 for controlling the brightness level of the LCD 12 is set to correspond to the ABL signal indexed by the AL signal, thereby adjusting the brightness level of the LCD 12 according to the current ambient lighting conditions. Again, it should be understood that upon power up of the LCD 12, the BC signal may initially be set to correspond to the value of USBL as stored in the NVRAM 211, rather than the value of the AL signal.

In step 504, a determination is made whether the AL signal has changed, indicating that the ambient lighting conditions have changed. If so, execution proceeds to step 506. In step 506, the new AL signal is used to index the ABL signal lookup table (not shown) stored in the memory 204*b*. Also in step 506, the BC signal output to the backlight driver circuitry 213 for controlling the brightness level of the LCD 12 is set to correspond to the ABL signal indexed by the new AL signal, thereby adjusting the brightness level of the LCD 12 according to the current ambient lighting conditions. Execution then proceeds to step 508. Similarly, if in step 504, it is determined that the AL signal has not changed, indicating that no adjustment for ambient lighting conditions is necessary, execution proceeds directly to step 508.

In step 508, a determination is made whether the USBL signal has changed. If the USBL signal has not changed, execution returns to step 504. In contrast, if the USBL signal has changed, indicating that the user has attempted to manually change the brightness level of the LCD 12, execution proceeds to step 509. In step 509, the lookup table entry corresponding to the current AL is adjusted according to the present USBL. In addition, previous USBL signals generated when the present ambient lighting condition is encountered are also preferably taken into account during the adjustment. Once the lookup table entry has been adjusted, execution proceeds to step 510. In step 510, the BC signal output to the backlight driver circuitry 213 is set to correspond to the USBL signal. Once the brightness of the LCD 12 has been set to the level indicated by the USBL signal in step 510, execution returns to step 504.

In this manner, the brightness control circuitry 204 is able to take into account the user's preferences with respect to preferred brightness control settings in particular ambient lighting conditions. In the preferred embodiment, the method illustrated in FIG. 5 is designed to constantly attempt to converge on the user's preferred setting for each range of ambient lighting conditions, thereby minimizing the necessity that the user will need to manually adjust the LCD 12 brightness setting.

It is understood that the present invention can take many forms and embodiments. The embodiments shown herein are intended to illustrate rather than to limit the invention, it being appreciated that variations may be made without departing from the spirit or the scope of the invention. For example, the LCD brightness control circuitry 204 could comprise some form of artificial intelligence, e.g., a neural network, for "learning" the user's preferred brightness settings in various ambient lighting conditions, as indicated by the control means setting, such that when the settings are later re-encountered, the LCD 12 will be automatically adjusted to the user's preferred brightness setting. Alternatively, the brightness control circuitry 204 could be simplified to provide a direct linear control signal of measured light to LCD brightness level, thus eliminating the need for the A/D converter 204*c* and microprocessor 204*a*.

Although illustrative embodiments of the invention have been shown and described, a wide range of modification, change and substitution is intended in the foregoing disclosure and in some instances some features of the present invention may be employed without a corresponding use of the other features. Accordingly, it is appropriate that the appended claims be construed broadly and in a manner consistent with the scope of the invention.

What is claimed is:

1. In an electronic device having a liquid crystal display (LCD), an apparatus for automatically adjusting the brightness of the LCD in response to ambient lighting conditions, the apparatus comprising:

a brightness control circuitry including a microprocessor and a memory;

means for manually adjusting the brightness of the LCD and generating a selected brightness level signal to the microprocessor;

a first photodetector for detecting a level of ambient light directed toward a first side of the LCD and for generating a first ambient light signal to the microprocessor;

means for converting the ambient light signal for input into the microprocessor;

the memory having automatic brightness level signals indexed by the ambient light signals;

means for determining the lower value of the selected brightness level signal and the automatic brightness level signal; and means for setting the brightness level of the LCD to correspond to the lower level indicated by the automatic brightness level signal and the selected brightness level signal.

2. The apparatus of claim 1 wherein said electronic device is a portable personal computer.

3. The apparatus of claim 1 wherein said first side is a front side of said LCD.

4. An apparatus for automatically adjusting the brightness of a liquid crystal display (LCD) in response to ambient lightning conditions, the apparatus comprising:

a brightness control circuitry including a microprocessor, a memory and an analog-to-digital (A/D) converter;

means for manually adjusting the brightness of the LCD and generating selected brightness level signals to the microprocessor;

a first photodetector for detecting a level of ambient light directed toward a first side of the LCD and for generating a first ambient light signal through the A/D converter to the microprocessor;

the memory having automatic brightness level signals stored therein indexed by the first ambient light signal;

means for generating a brightness control signal to correspond to the selected brightness level signal;

means for generating a brightness control signal to correspond to the automatic brightness level signal;

means for determining the lower value of the selected brightness level signal and the automatic brightness level signal; and means for setting the brightness level of the LCD to correspond to the lower level indicated by the automatic brightness level signal and the selected brightness level signal.

5. The apparatus of claim 4 wherein said means for manually adjusting is a function key of said electronic device.

6. In an electronic device having a liquid crystal display (LCD), a method of automatically adjusting the brightness of the LCD in response to ambient lighting conditions, the method comprising the steps of:

manually adjusting the brightness level of the LCD and generating a selected brightness level signal to a microprocessor;

detecting a level of ambient light directed toward one side of the LCD and generating an ambient light signal to the microprocessor;

storing an automatic brightness level signal in a memory;

indexing the automatic brightness level signal to the ambient light signal;

determining the lower value of the selected brightness level signal and the automatic brightness level signal; and setting the brightness level of the LCD to correspond to the lower value indicated by the automatic brightness level signal and the selected brightness level signal.

7. The method of claim 6 wherein said electronic device is a portable personal computer.

8. The method of claim 6 wherein said first side is a front side of said LCD.

* * * * *